United States Patent [19]

Przytulla

[11] Patent Number: 4,674,648

[45] Date of Patent: Jun. 23, 1987

[54] BUNG KEG

[75] Inventor: Dietmar Przytulla, Sindorf, Fed. Rep. of Germany

[73] Assignee: Mauser-Werke GmbH, Bruhl, Fed. Rep. of Germany

[21] Appl. No.: 889,989

[22] Filed: Jul. 24, 1986

[30] Foreign Application Priority Data

Jul. 27, 1985 [DE] Fed. Rep. of Germany ..... 3526921

[51] Int. Cl.[4] ..... B65D 7/44

[52] U.S. Cl. ..... 220/72; 220/5 R

[58] Field of Search ..... 220/72, 74, 70, 83, 220/5 R, DIG. 1

[56] References Cited

U.S. PATENT DOCUMENTS

| | | | |
|---|---|---|---|
| 3,934,747 | 1/1976 | Needt | 220/72 X |
| 4,169,537 | 10/1979 | Sabreen et al. | 220/72 X |
| 4,209,104 | 6/1980 | Speas | 20/5 R X |
| 4,228,911 | 10/1980 | Hammes | 220/72 X |
| 4,257,527 | 3/1981 | Snyder et al. | 220/5 R X |
| 4,264,016 | 4/1981 | Speas | 220/5 R X |
| 4,378,328 | 3/1983 | Przytulla et al. | 220/72 X |

*Primary Examiner*—Steven M. Pollard

*Attorney, Agent, or Firm*—Pennie & Edmonds

[57] ABSTRACT

Bung keg having a carry and transport ring molded to the envelope by a connecting web. The bottom edge and the vertical inner wall of the ring provide bearing surfaces for the keg grab. The connecting web merges into the envelope at an acute angle, while the grooved portion of the web, between the vertical inner wall and the keg head, has a bottom point that is in the same horizontal plane as the bottom edge. Besides being formed by a blown method, the bung key can be constructed by welding prefabricated components together.

4 Claims, 3 Drawing Figures

BUNG KEG

BACKGROUND OF THE INVENTION

The invention relates to a bung keg of thermoplastic material having at least one carry and transport ring molded in one piece with the envelope. The envelope of the keg is arranged in the vicinity of an associated head surface, and has a vertical bearing surface for the jaws of a keg grab.

Plastic kegs equipped in this way can be picked up and transported, without any hand manipulation, using conventional keg grabs of a lift truck.

Ordinarily, such carry and transport rings have a cross section with a horizontal and a vertical web. The free end of the vertical web points towards the head surface of the keg, while the horizontal web is molded radially outward from the bottom of the barrel.

The rationale for this ring design, is so the jaws of the keg grab can slide under the annular web directed horizontally outward, and behind the web that is directed vertically upward. By using such a design, the whole load of the keg is transmitted to the lower jaw through the web directed horizontally outward, while the jaw engaged behind the vertical web secures the keg from slipping. This design permits the kegs to be hoisted and transported.

The kegs are normally constructed using a blow molding method. In this process, two mold halves, which are separable along a vertical plane, are used. The upper and lower region of each mold half is horizontally divided to provide mold parts which slide one into the other.

An extrusion head of the blowing machine delivers a parison or preform of extruded plastic between the mold halves which are in the separated position. During this extrusion process, the sliding mold parts in each mold half are opened. After the parison is lowered in the axial direction of the drum into the mold, the two mold halves are closed. In the closed position the mold halves clamp the previously extruded parison at what will be the head and bottom ends of the drum creating a seam across both clamped portions of the parison. The blowing process is then commenced. Molding apparatus of this type is conventional. A mandrel expands the parison so that it is pressed outwardly against the inner wall of the closed mold and, as a result, assumes the predetermined shape of the drum. With the upper and lower mold parts of each mold half disposed in an open position, the material of the parison enters into the recesses formed by the open mold parts. With such a mold construction, radially outwardly extending channels are formed on the container during the blow molding operation. These channels open toward the inside of the container.

Subsequently, the mold parts are moved relative to one another into a closed position. The mold parts which can be moved relative to one another are shaped to provide the carry and transport ring configuration and the material of the channels pressed into the recesses provided by the mold parts forms the carry and transport ring when the mold parts are moved relative to one another. It is in this ring area that the highest tensile and bending stresses are found.

SUMMARY OF THE INVENTION

The primary object of the present invention is to prevent weld zones near the carry and transport ring from failing. By relieving the bending stresses in the welds, by designing a carry and transport ring that becomes elastic in the circumferential direction and thereby deformable relative to the envelope under impact load, ring failures can be prevented.

This objective is accomplished by the careful positioning of the carry and transport ring. The ring is attached to the keg by way of a connecting web, which has a bottom edge that merges with the envelope at an acute angle to the axis of the keg.

The advantage of positioning the connecting web at an acute angle to the keg and the envelope, is that this construction only subjects the web to harmless tensile loads when the keg is being transported. Therefore, the connecting web may be comparatively thin walled, which allows the web to be more elastic.

This elasticity is further enhanced in that a groove, located between the carry or transport ring and the keg head, has a bottom point that is in the same horizontal plane as the bottom edge. The result of this positioning, is that when the keg is dropped the carry and transport ring is bent inward so that its vertical inner wall strikes the envelope. The bending stresses are thereby transmitted from the web to the homogeneous areas of the envelope.

Another means for preventing web failure is to increase the density of the material in the web. This is accomplished by displacing additional material into the web through the inward movement of the mold parts that form the carry and transport ring's circumferential indentation. As a result of this method of manufacturing, the weld zone is located downward from the critical ring area, and thereby strengthened to resist the bending stress.

The design of the present invention also provides a slip-proof bearing surface for the keg grab jaws. In this construction, the vertical bearing surface, i.e., the vertical inner wall, is inclined outward at an acute angle from the longitudinal axis of the keg. Contrastingly, the horizontal bearing surface, i.e., the bottom edge of the carry and transport ring, is inclined downward at an acute angle to the central transverse plane of the keg. Through this design, the carry and transport ring is more tightly secured to the grab jaws, thereby preventing the ring from sliding out of the horizontal jaw.

Instead of using a blowing process to form the entire keg, the keg components could be separately constructed and then attached together. Specifically, the head base and envelope could be prefabricated, and then have their adjacent welding edges preheated and pressed together.

A BRIEF DESCRIPTION OF THE DRAWINGS

DETAILED DESCRIPTION OF THE PREFERRED EMBODIMENTS

Figure 1:
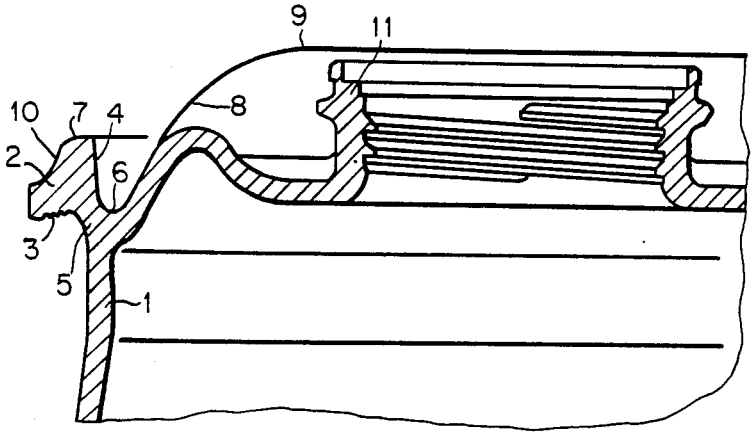
FIG. 1 is a longitudinal cross-sectional view of the bung keg showing a portion of the keg head.
Figure 2:
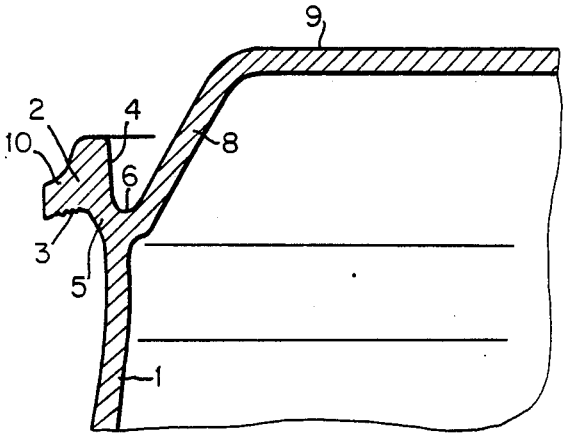
FIG. 2 is a longitudinal cross-sectional view of the bung keg without any bung.

The bung keg includes an envelope 1 and a head 9. Within head 9, bungs 11 are arranged in recesses. Outwardly below and adjacent to head 9 is a carry and transport ring 2. Ring 2 contains free end 7, bottom edge 3, and vertical inner wall 4. Bottom edge 3, directed radially outward and downward at an acute angle to the central transverse plane of the keg, along with vertical inner wall 4, inclined outward from the central axis of the keg, form the respective horizontal and vertical bearing surfaces for the keg grab.

Adjacent to transport ring 2 and envelope 1 is surface 8 that slopes upward and inward into head 9. The purpose of surface 8 is to provide the keg grab the needed room to grab vertical inner wall 4.

Connecting transport ring 2 to envelope 1 is web 5. Web 5 merges into envelope 1 at an acute angle to the axis of the keg, while having a groove 6, between vertical inner wall and surface 8. Groove 6 has a bottom point that is in the same horizontal plane as bottom edge 3.

Forming the outside edge of carry and transport ring 2, is indentation 10. Indentation 10 is obliquely located from web 5 so that in the formation process web 5 can be strengthened.

Figure 3:
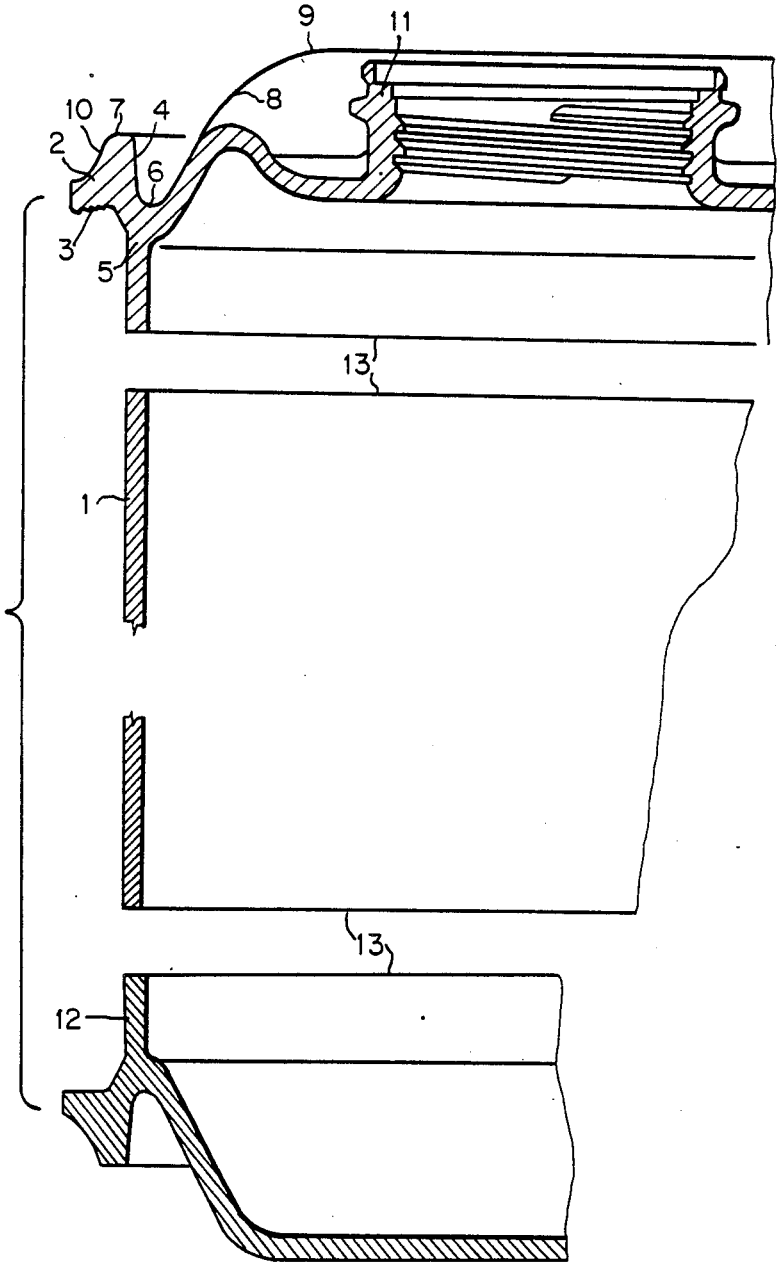
FIG. 3 is a longitudinal cross-sectional view of the prefabricated components of the keg assembly.

FIG. 3, shows an alternate embodiment of the prefabricated envelope 1, head 9, and base 12 for assembling a keg. While both head 9 and base 12 are constructed by an injection-molding process, envelope 1 is formed by blown molding. The components are then welded together along edge 13 by preheating edges 13 and subsequently vertically pressing the components together.

I claim:

1. A bung keg of thermoplastic material having at least one carry and transport ring, molded in one piece with the envelope of the keg and arranged in close proximity to the associated head and bung holes of the keg, with a horizontal and vertical bearing surfaces for the keg grab jaws to hold onto, wherein:

(a) a connecting web, connecting the carry and transport ring to the keg and adjoining a bottom edge surface of the ring, merges with the envelope at an acute angle to the axis of the keg;

(b) an upwardly tapered surface, merges into the keg head to provide room for the keg grab; and (c) a groove, located on the top portion of the connecting web between the carry and transport ring and the upwardly tapered surface, has a bottom point aligned in the horizontal plane of the bottom edge.

2. A bung keg according to claim 1, wherein:

(a) a vertical inner wall of the carry and transport ring is inclined outward at an acute angle to the longitudinal axis of the keg; and (b) the bottom edge is inclined downward at an acute angle to the central transverse plane of the keg.

3. A bung keg according to claim 2, wherein:

(a) an outer rim surface of the carry and transport ring has a circumferential indentation obliquely opposed to the connecting web.

4. A bung keg according to claim 3, wherein:

(a) the keg is constructed by welding a prefabricated base head, and envelope together.

* * * * *